United States Patent [19]

Irons

[11] 4,006,082

[45] Feb. 1, 1977

[54] PROCESS FOR EMERGENCY SMALL SPILL CONTROL

[75] Inventor: Denis E. Irons, San Francisco, Calif.

[73] Assignee: Murphy Pacific Marine Salvage Co., Emeryville, Calif.

[22] Filed: May 12, 1975

[21] Appl. No.: 576,944

[52] U.S. Cl. ..... 210/83; 61/1 F; 210/242 S; 210/DIG. 25

[51] Int. Cl.[2] ..... E02B 15/04

[58] Field of Search ..... 61/1 F; 210/23 R, 30 A, 210/83, 170, 242, 248, 540, DIG. 21

[56] References Cited

UNITED STATES PATENTS

| | | | |
|---|---|---|---|
| 3,184,923 | 5/1965 | Galuaing | 61/1 F |
| 3,539,013 | 11/1970 | Smith | 210/242 |
| 3,592,006 | 7/1971 | Crucet | 61/1 F |
| 3,631,679 | 1/1972 | Fisch | 61/1 F |
| 3,748,264 | 7/1973 | McCombie | 210/DIG. 21 |
| 3,757,953 | 9/1973 | Sky-Eagle, Jr. | 210/242 |
| 3,759,390 | 9/1973 | McCombie | 210/242 S |
| 3,921,407 | 11/1975 | Neal | 61/1 F |

*Primary Examiner*—Charles N. Hart
*Assistant Examiner*—R. G. Mukai
*Attorney, Agent, or Firm*—Townsend and Townsend

[57] ABSTRACT

A process for the collection of lighter than water pollutant spills to a small boat contained emergency collection sump is disclosed. A floating sump is disposed onto the surface of the water near a spill for the collection of pollutants at a surface disposed lip on the sump. A floating and flexible boom, dead ended to one side of the sump lip, is disposed from the sump to surround the spill. The boom is threaded through vertical take up rollers and then dead ended to the side of the small boat used for the control of the spill. Upon collection of the floating boom at the vertical take up rollers, collection and confinement of pollutants to two confined areas occurs. With regard to the spill as initially surrounded, the boom, when collected, defines a first decreasing area forcing the collection of the surface disposed pollutants to the sump lip. Interior of the sump, the solution inlet to a collecting pump is disposed at an elevation with respect to the surface of the ambient waters so that collection of pollutants only occurs. Secondly, as the boom is passed from the sump to and beyond the sump, a second pollutant containment area is defined. This second pollutant containment area typically surrounds the residual non-collected pollutants. This second area may be subsequently cleaned by using towels on the surface of the water. By the process of manipulating the boom back and forth to define respective decreasing and increasing pollutant collection areas, collection by pumping or sponging can occur at leisure until complete abatement of the spill occurs.

1 Claim, 9 Drawing Figures

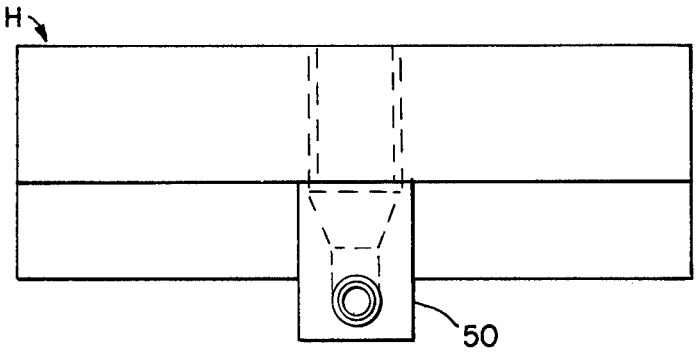
FIG _ 6
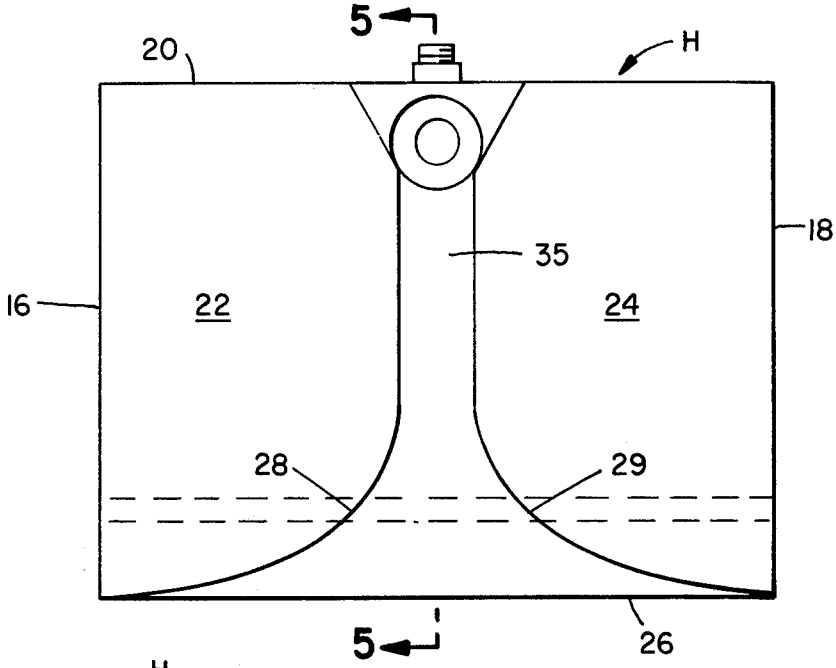
FIG _ 7
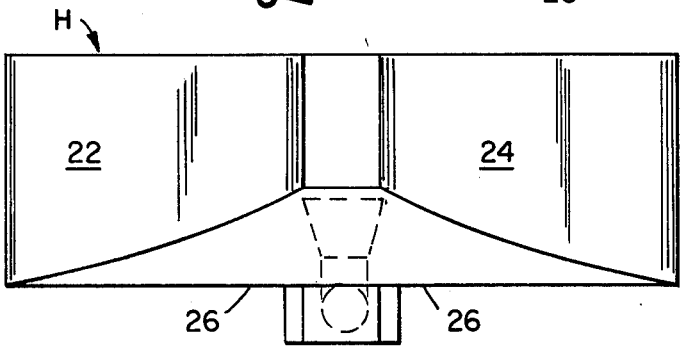
FIG _ 8
FIG _ 9
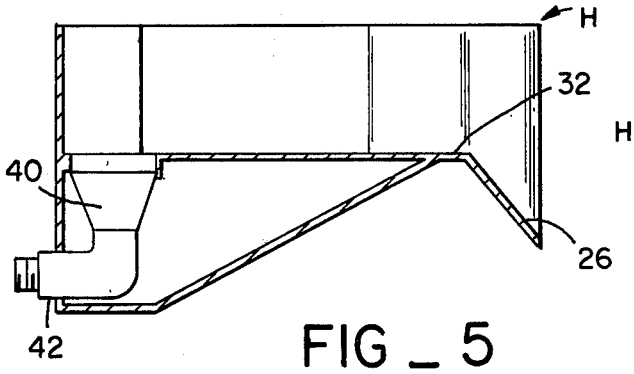
FIG _ 5
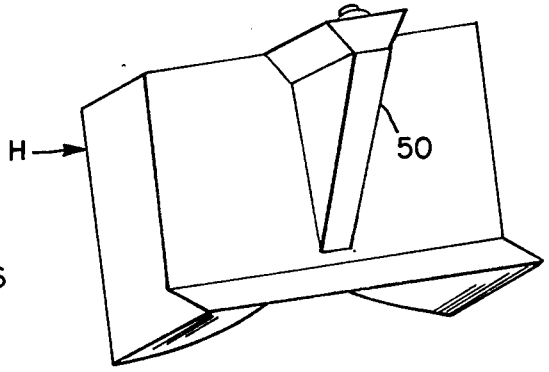

PROCESS FOR EMERGENCY SMALL SPILL CONTROL

This invention relates to a process for the control of small polluting spills such as from oil vessels. More particularly, this invention relates to an oil collection process adapted for use from a ship's boat for the collection of oil spills common in vessel fueling.

SUMMARY OF THE PRIOR ART

Heretofore, systems for removing floating oil from water have included vessels traveling through or about an oil slick. Typically, a boom is towed behind such vessels to surround the slick. During towing, the slick is usually funnelled to a trailing collecting point with respect to the towing vessels.

These systems have included numerous disadvantages. For example, more than one vessel has to be used in many such schemes. Vessels, in traveling through the water at or around the spill, agitate and disturb the spill causing further spill dispersion. Moreover, the collecting apparatus at the trailing part of the boom is in most cases extremely mechanically complex. Specially controlled weirs and the like are frequently towed, which weirs are not adaptable for simplified emergency disposition in a spill situation. Finally, pollutant collection is required to be efficient to the point where any "visible sheen" remains on the surface of the water. In cases where such a visible sheen remains, pollution likewise remains.

NATURE OF THE PROBLEM

Polluting spills from ships typically occur as a result of the fuel bottom "topping off" process. Typically, and before going to sea, a ship has its fuel bottom pumped full of standard fuel oil. As the fuel bottom approaches the full state, it frequently rises to a relatively narrow neck with the rate of rise of the fuel oil being greatly accelerated as the tank nears full capacity. When the tank becomes overfilled, spill suddenly occurs from at least two onboard ship locations.

First, the air vent which allows for the escape of air spews oil, typically onto the ship's deck. Secondly, the fuel trunk through which fuel is being introduced typically backs up. The interstitial area around the hose supplying fuel and the truck into which the hose penetrates backflows oil. In either case, oil runs from the deck through the skuppers of the vessel, down the vessel side, and into the water.

It will be appreciated by those skilled in the art of topping off fuel bottoms that such spills can easily occur. Moreover, this problem is particularly aggravated by warships where fuel bottoms contoured to long thin hulls have rapidly rising necks of small dimension greatly aggravating the spill problem during the "topping off" process.

Most such spills are typically controlled after less than 100 gallons of oil have been discharged. Heretofore, the individual onboard capability of a ship in responding to such spills has been poor.

In the event that such a spill has occurred, the ship's personnel can call for and receive aid from commercial contractors specializing in the cleanup of oil spills. Unfortunately, the timed interval commencing with when the spill occurs and ending with the arrival of the contractor at the scene of the spill, is often great. Oil dispersion due to wave action, wind action, or spreading of the spill over a large surface of water area frequently occurs before help can arrive.

Moreover, besides the obvious fire hazard which such spills present (especially aggravated in the case of nearby piers and wharfs), these oil spills have now been recognized to be a pollutant hazard endangering both water fowl and marine life. Recently determined legal standards classify any "visible sheen" as pollution with applicable civil penalties of relatively large magnitudes. In almost all cases the capability of a ship's force to immediately respond to such spills both lessens the actual pollutant damage which the spills cause and provides mitigating factors in which local judicial authorities can lessen the applicable statutory penalties.

SUMMARY OF THE INVENTION

A process for the collection of lighter than water pollutant spills to a small boat contained emergency collection sump is disclosed. A floating sump is disposed onto the surface of the water near a spill for the collection of pollutants at a surface disposed lip on the sump. A floating and flexible boom, dead ended to one side of the sump lip, is disposed from the sump to surround the spill. The boom is threaded through vertical take up rollers and then dead ended to the side of the small boat used for the control of the spill. Upon collection of the floating boom at the vertical take up rollers, collection and confinement of pollutants to two confined areas occurs. With regard to the spill as initially surrounded, the boom, when collected, defines a first decreasing area forcing the collection of the surface disposed pollutants to the sump lip. Interior of the sump, the suction inlet to a collecting pump is disposed at an elevation with respect to the surface of the ambient waters so that collection of pollutants only occurs. Secondly, as the boom is passed from the sump to and beyond the sump, a second pollutant containment area is defined. This second pollutant containment area typically surrounds the residual non-collected pollutants. This second area may be subsequently cleaned by using towels on the surface of the water. By the process of manipulating the boom back and forth to define respective decreasing and increasing pollutant collection areas, collection by pumping or sponging can occur at leisure until complete abatement of the spill occurs.

OBJECTS AND ADVANTAGES OF THE INVENTION

An object of this invention is to disclose a process for the collection of spilled fuel oil from water which can completely abate a spill. According to this process, a floating sump having a collecting lip is disposed on the surface of the water. A boom is dead ended on one side of the sump lip and collected at the remaining side of the sump lip. When the boom is placed around a spill in the water and threaded through the collecting means of the sump, it is typically dead ended as collected to the side of a ship's boat working the spill. Thus, the boom as collected defines a secondary containment area, which area can confine oil not collected to the sump. This secondary area may subsequently be sponged or toweled to remove any visible oil sheen.

An advantage of this process is that gross pollutants are immediately collected to a sump. Only residual pollutants are passed to the secondary area.

A further advantage of this invention is that the secondary area can contain the residual "visible sheen".

This visible sheen can subsequently be collected by conventional toweling methods.

Yet another advantage of this invention is that the boom can be passed back and forth at the collecting means of the sump to define respective increasing and decreasing oil containment and collection areas. Oil collection can occur either to the sump or by toweling in an area when it is decreased. When the area increases, it still maintains a boundary preventing the penetration of oil to adjacent areas.

A further advantage of this process is that once the boom is disposed upon the surface of the water for spill collection, it remains until the spill is collected. Collection of the boom from the water during spill control with associated loss of the spill barrier is not required.

It is an advantage of the disclosed process that it is adaptable to be worked from a ship's boat. Moreover, the process is of such simplicity that it is readily understood and worked by able bodied seamen.

Yet another advantage of the collection method of the disclosed apparatus is that once containment of a spill is accomplished by dispersion of a floating boom around an oil slick, collection of the slick from the interior of the boom can occur at leisure. Thus, where a cleanup crew in the collection of the boom in the first instance misses a quantity of oil, a repeat sequence of manipulation of the boom can follow. What is missed or omitted in cleanup in the first boom manipulation can be gathered in the second boom manipulation. Likewise, third and fourth manipulations of the boom are possible to effectively remove all visible sheen produced by the pollutant spill from the surface of the water.

An additional advantage is that a minimum of vessel maneuvering is required during spill control. Moreover, maneuvering of small boats through the spill is unnecessary. Agitation of the spill is at an absolute minimum.

Likewise, other objects, features and advantages of this invention will become more apparent after referring to the following specifications and attached drawings in which.

Figure 1:
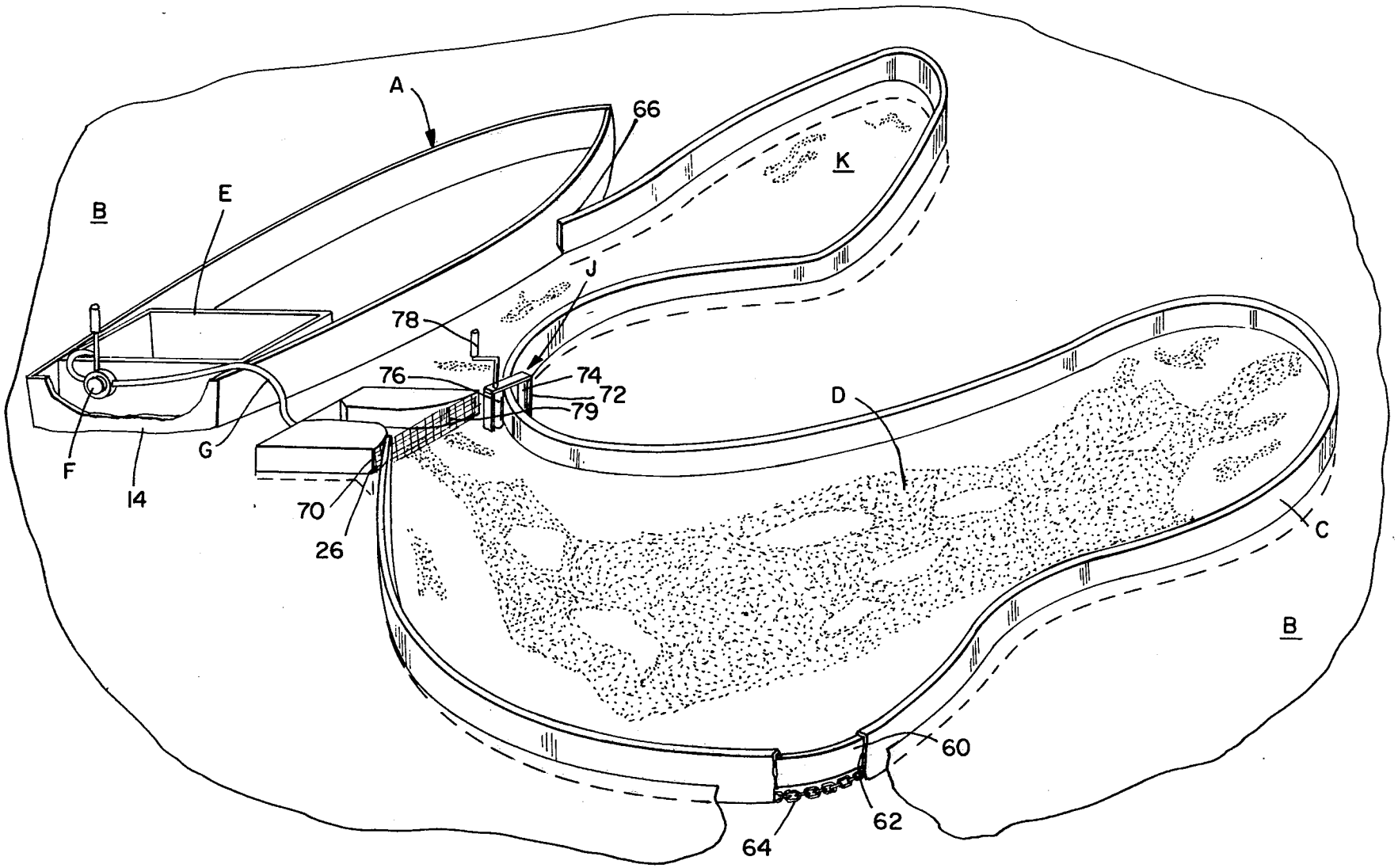
FIG. 1 is a perspective view of the pollutant control apparatus of this invention illustrating a ship's boat in the water with the pollutant receiving container disposed therewithin, a sump disposed at the starboard side of the boat with the boom in the process of being collected.

Referring to FIG. 1, a ship's boat A is shown on the surface of harbor water B having boom C surrounding an oil spill D. The stern section of the ship's boat at 14 is broken away so that a pollutant receiving container E can be seen within the boat. This container E has a pump F connected through hosing G to a sump H. By the expedient of operating sump H and collecting boom C through rollers J, the oil spill D can be collected from the surface of the water B and thereafter pumped interior of the container E in the ship's boat A.

Referring to FIGS. 5–9, the construction of the floating sump H can be illustrated.

Referring to FIG. 7, sump H includes sidewalls 16, 18 and an end wall 20. In between these respective side and end walls are shown two foam floats 22, 24 which provide to the sump the required buoyancy. Typically, floats 22, 24 as well as all surfaces within the sump are coated with fiberglass.

It can be seen that the floats 22, 24 are designed to provide a constricting channel 35 across a frontal lip 26 at the forward portion of the float. Thus, float 22 at a radius 28, and float 24 at a radius 29, provide a channel there between for receiving the collected pollutants.

Referring to FIG. 5, a section of the sump taken along lines 5—5 of FIG. 7 is illustrated. It will be seen that at lip 26 a penetration of the lip below the ambient water level for a distance of at least 4 inches occurs. The bottom surface of the lip tapers upwardly to a weir 32 which is typically designed to be just below the level of the ambient surface level, say in the order of one half inch. As oil passes over the weir and interior of channel 35 defined between the respective floats 22, 24, it flows rearwardly and to a funnel 40 with connected take-out drain 42.

Typically, funnel 40 is adjustable in elevation. That is to say, it can be moved upwardly and/or downwardly with respect to the level of the ambient water in which the sump is disposed. Thus, the funnel is adjustable both for the level of pollutant floating over the ambient water and to differing elevations of the sump when it is disposed in the water. For example, small changes in sump elevation may be anticipated where a seagoing vessel is in a fresh water port and the ambient water has a lesser density.

Referring to FIGS. 6 and 9, it will be seen that the sump is disposed with a keel 50. Keel 50 serves two functions. First, it maintains the float in a stabilized, upright disposition. Secondly, it forms the low point at take-out 42 at which the suction end of a positive displacement pump can be connected by applicable hosing to take-out 42.

Having set forth the configuration of the sump H, the construction of the boom can now be set forth with respect to FIG. 1.

Boom C is a flexible curtain-type boom of approximately twelve inches overall in depth. In includes a circular polyvinyl chloride material 60, electronically welded into typical 50 foot lengths. This material has disposed in the upper portion thereof an ethyfoam float material 62 preferably one half inch thick.

The lower end of the curtain contains one quarter inch chain 64. As is typical, the respective ends of the boom are sealed as by a seal 66. Preferably, over half the material of the floating boom is disposed as a curtain below the surface of water B. This underwater curtain penetrates the water/oil interface and enables the isolation of the oil on one side of the boom from unpolluted water on the other side of the boom.

Preferably, boom C is dead ended to one side of lip 26 at a bracket 70. The boom is disposed in its partially immersed condition around the periphery of the oil spill D and threaded through a roller assembly 72.

Roller assembly 72 consists of paired upright rollers 74, 76. Typically, roller 76 is rotated by an attached handle 78. By confronting the floating boom C between the paired rollers, the boom is collected with clockwise rotation of handle 78 so as to collect the pollutants D interior of the sump.

Preferably, a screen 79 is placed across the opening to the sump. This screen serves to block the entrance of clogging debris into the funnel, hose, and pump assembly. Those experienced with shipboard life will appreciate that many harbors include a measure of surface debris far above that normally found in open waters. As such harbors are the scene of most spills, provision for debris separation is made.

Returning to FIG. 1, it can be seen that a hose G connects sump H and pump F. Typically, hose G at the pump and at the sump is fitted with quick release clamps such as those clamps sold under the trademark KAMLOCK by the Gates Company of San Francisco, Calif.

The pump here shown is a 20 gallon-per-minute, hand operated, positive displacement, bilge pump sold by Henderson Pumping Equipment, Ltd. of Cowes, England. This pump is of the type wherein a cover can be removed for the cleaning of debris from the pump.

It will be appreciated by those skilled in the art that a preferred location for the placement of the pump will be on the inside of the box. Thus, any cleaning of the pump which occurs will not cause oil to be discharged interior of the ship's boat A. The pump is shown here at the outside for ease of understanding.

The discharge line to the pump is passed interior of the pollutant receiving container E.

It should be appreciated that incidentals will be provided with this kit. For example, these incidentals can include disposable coveralls, nylon line for towing the boom through the water behind the boat, a floating knife, solvent for cleaning the kit, and sorbent pads. Typically, the pads are oleophilic treated and hydrophobic as to water. Such pads may be purchased from Sorbent Sciences of Covina, Calif.

Figure 3:
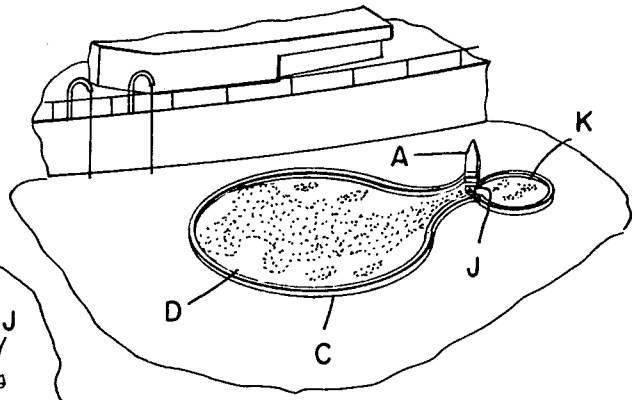
FIG. 3 is a view of the spill on the surface of the water illustrating collection of the oil to a first gross pollutant receiving area with the boom beginning to define a secondary pollutant receiving area.
Figure 4:
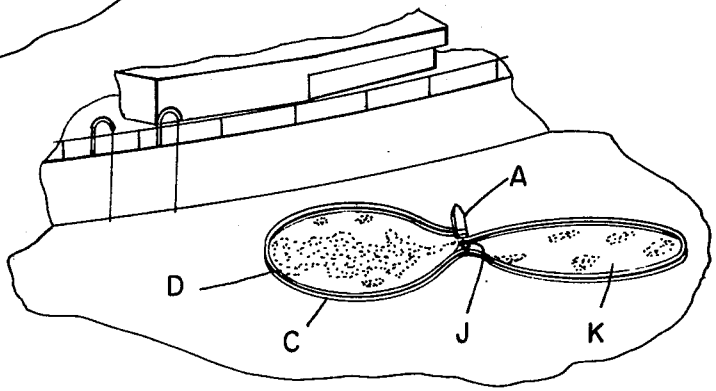
FIG. 4 illustrates the collection of the first pollutant receiving area to discharge oil to the sump with a second pollutant receiving area being defined between the sump and vessel working the spill; and, FIGS. 5–9 comprise respective plan and elevation views of the sump used with this invention.
Figure 2:
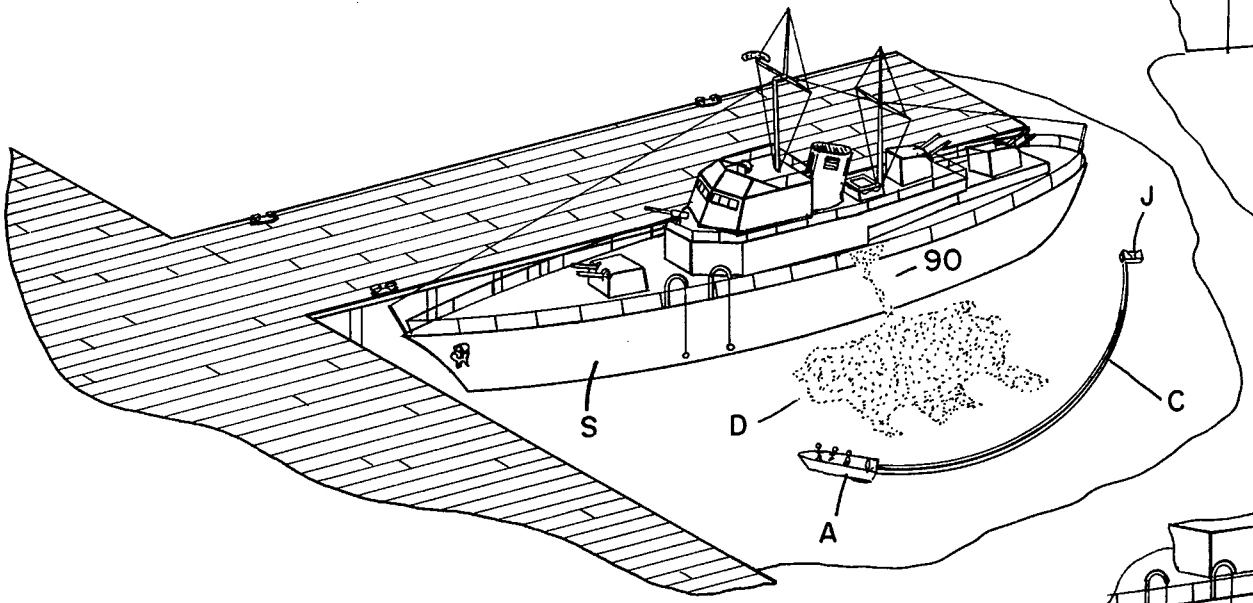
FIG. 2 is a perspective view of a warship immediately after a polluting spill has occurred with a sump disposed in the water and a ship's boat maneuvering the boom to surround the spill.

The operation of the process of this invention can be easily understood with reference to the cartoon series of FIGS. 2, 3 and 4. Referring to FIG. 2, ship S is illustrated with a spill D occurring at the port side amidships. As can be seen, oil has flowed through the ship's deck skuppers down the side of the ship at 90 to form the spill D. During the fueling operation, ship's boat A with the pollution damage control kit of this invention is maintained at the ready. Preferably, boat A is swung outboard on its davits and lowered to a level even with the deck.

When the spill occurs, the crew immediately boards the ship's boat and the boat is lowered into the water. Thereafter, the boat deposits sump J with one end of boom C dead ended to the sump. Thereafter, boom C and sump J are trailed behind the boat while the ship's boat encircles the spill D.

It is important to note that this encirclement occurs almost at once. Thus, the ship's boat is in the water minutes after the polluting spill occurs.

Returning to FIG. 1, the disposition of the boom surrounding the spill D is shown. Specifically, boom C is moved to surround the oil spill D. Thereafter, the end of the boom at 66 is threaded between the vertical take up rollers 74, 76 and collection of the boom commenced by the rotation of handle 78. When a sufficient section of the boom has been passed through the vertical take up rollers 74, 76, the boom in turn is dead ended to the side of boat A working the spill.

It is important to note at this juncture that the boom defines two containment areas. The first is the containment of the gross spill at D. The second is the secondary containment area of the spill at K.

Referring to FIG. 3, the disposition of boom C is shown about the spill D with the secondary containment area K beginning to form.

When the spill is surrounded as shown in FIG. 3, rollers J will be activated to collect the floating curtain to the lip of the sump. Simultaneously, oil D within the interior of boom C will be collected off the surface of water B. By simultaneously controlling the level of the funnel, operating the pump in a suction mode, and collecting boom C, immediate collection of oil from the surface of the sea can occur from area D.

Referring to FIG. 4, it will be seen that secondary area K has been defined between sump J and ship's boat A. This secondary area K would typically have confined within it a visible oil sheen.

It has been found that this visible oil sheen is generated from a number of sources. First, the inside wall of boom C disposed towards spill D contains some oil over the surface thereof. This oil can contaminate water to which the boom is passed. Secondly, the rollers at and around the sump do serve to pass some oil. Since, however, the water curtain provided by boom C is essentially uninterrupted as the boom passes through the vertical take-up rollers, little or no passage of oil from one side of the boom to the other side of the boom occurs. Finally, all the oil of the spill may not initially be surrounded. Thus, it may be desired to manipulate the free end of the boom either from another ship's boat or from boat A so as to surround and contain additional polluted surface area.

It will be appreciated that the boom take-up apparatus of this invention has an advantage not immediately apparent. Typically, such floating booms disposed over the surface of the water can, at their points of collection from the water, serve to pass oil under or around the boom. It is important to note that boom C of this invention is never collected from the water until the spill is fully contained. Only the respective areas D and K grow and diminish in their size. When the areas are diminished, collection of the surrounded oil from them occurs. When the areas are expanded, they nevertheless serve to contain the spill.

Likewise, it will be appreciated by those skilled in the art that a number of manipulations of the boom to draw oil across the lip of the sump can occur. Likewise, successive areas can be toweled with area K first being toweled, and area D next being toweled. Thus, through a sequence of manipulations, oil can be fully collected from the surface of the water near the vessel.

It should be appreciated that the process disclosed herein will admit of modifications. For example, more than two containment areas can be used.

I claim:

1. A process for the collection of lighter than water pollutant spills from a vessel working the spill, said process comprising the steps of: disposing a floating sump onto the surface of water near a spill; providing a floating and flexible boom having a first portion above water and a second portion below water; attaching one end of said boom to said floating sump; placing said boom in said water to surround at least a portion of said spill; providing take-up means disposed through the surface of said water at a second point on said sump; positioning said sump adjacent said vessel working the spill; threading one end of said boom through said take-up means with said spill contained between said sump and said boom; operating said take-up means to collect said boom to define a first decreasing area and contracting the area of said lighter than water pollutant spills; dead-ending the other end of said boom as passed through said take-up means to said vessel to define a second and increasing pollutant containment area; passing said boom through said take-up means in a first direction to sequentially decrease said first area and expand said second area; passing said boom through said take-up means in a second direction to sequentially decrease said second area and increase said first area; and, collecting said lighter than water pollutant spills from said first and second decreasing pollutant containment areas.

* * * * *